United States Patent [19]

Frazier

[11] 4,181,176

[45] Jan. 1, 1980

[54] OIL RECOVERY PREDICTION TECHNIQUE

[75] Inventor: Gregory D. Frazier, Houston, Tex.

[73] Assignee: Texaco Inc., White Plains, N.Y.

[21] Appl. No.: 958,312

[22] Filed: Nov. 6, 1978

[51] Int. Cl.[2] ..... E21B 43/22; E21B 47/10

[52] U.S. Cl. ..... 166/252; 166/251

[58] Field of Search ..... 166/252, 251; 364/804; 204/195 R

[56] References Cited

U.S. PATENT DOCUMENTS

| | | | |
|---|---|---|---|
| 2,352,834 | 7/1944 | Hassler | 166/252 |
| 2,553,900 | 5/1951 | Doan et al. | 166/252 |
| 2,639,090 | 5/1953 | Sherborne | 364/804 |
| 2,683,563 | 7/1954 | Lee et al. | 204/195 R |
| 3,038,656 | 6/1962 | Horwitz | 364/804 |
| 3,333,631 | 8/1967 | Heller | 166/252 |
| 3,362,473 | 1/1968 | Foster | 166/252 X |
| 3,508,875 | 4/1970 | Sandiford | 166/252 X |
| 3,684,872 | 8/1972 | Clauset, Jr. et al. | 364/804 |

*Primary Examiner*—Stephen J. Novosad

*Attorney, Agent, or Firm*—Carl G. Ries; Robert A. Kulason; Gregory A. Cone

[57] ABSTRACT

This method provides a means of determining the optimal injection and production rates for a given well pattern for use in enhanced recovery projects in petroleum reservoirs. A streamtube model for the pattern for a given injection and production rate is determined. Data from this model are plotted as a function of percentage of streamtubes exhibiting breakthrough to production wells versus time. A series of these graphs is plotted for different injection-production rates, and the model exhibiting the highest percentage of streamtube breakthrough within a reasonable time is selected.

8 Claims, 5 Drawing Figures

OIL RECOVERY PREDICTION TECHNIQUE

BACKGROUND OF THE INVENTION

1. Field of the Invention

This invention relates to the recovery of oil from a petroleum reservoir, being a method to select the most efficient injection and production rates for a given well pattern.

2. Description of the Prior Art

The crude oil which has accumulated in subterranean reservoirs is recovered or produced through one or more wells drilled into the reservoir. Initial production of the crude oil is accomplished by "primary recovery" techniques wherein only the natural forces present in the reservoir are utilized to produce the oil. However, upon depletion of these natural forces and the termination of primary recovery, a large portion of the crude oil remains trapped within the reservoir. Recognition of this fact has led to the development and use of many enhanced oil recovery techniques. Most of these techniques involve injection of at least one fluid into the reservoir to produce an additional portion of the crude oil therefrom. Some of the more common methods are water flooding, steam flooding, in situ combustion, surfacant flooding, $Co_2$ flooding, polymer flooding and caustic flooding.

The economic success of any of these techniques is measured by its ability to recover a quantity of oil which is more valuable than the cost of the process for recovering that quantity of oil. It is therefor of paramount importance to employ the most efficient methods possible in the practice of these oil recovery techniques. The cost of the injected chemicals is commonly quite high, and there is a need to be able to select injection and production rates so as to be able to confine these injected chemicals to the area of interest in the reservoir. Also, determination of the optimum injection and production rates for the wells in a particular area of a petroleum reservoir would allow precise employment of the most cost-effective production equipment at the site.

SUMMARY OF THE INVENTION

This invention comprises a method for optimizing the injection and production rates for wells in a petroleum reservoir undergoing an oil recovery operation. The method of this invention is practiced by generating a finite number of streamtubes for a pattern of injection and production wells for different sets of injection and production rates, comparing for each injection well the percentage of streamtubes exhibiting breakthrough to a producing well versus time for each of the different sets of injection and production rates and selecting the set of injection and production rates that provides a high overall percentage of streamtubes exhibiting breakthrough within a reasonable time.

DESCRIPTION OF THE PREFERRED EMBODIMENTS

Figure 1:
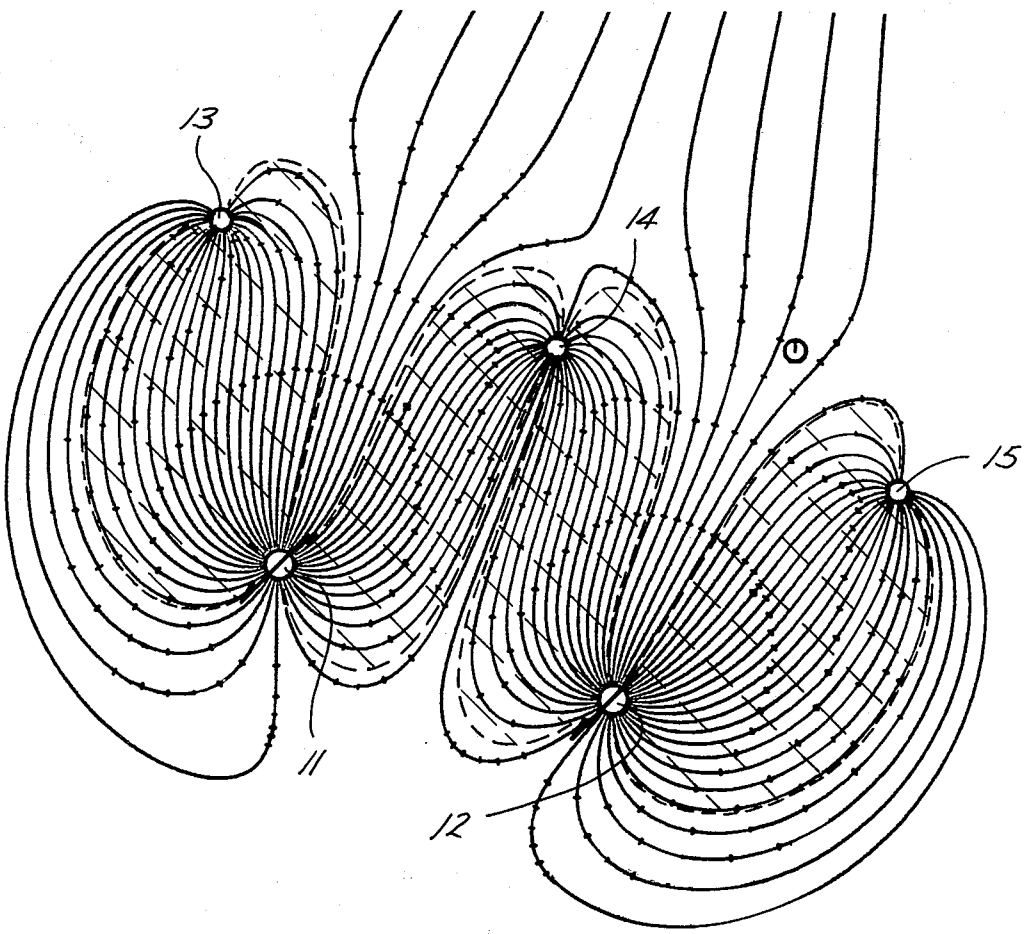
FIGS. 1, 2, 3, and 4 show in plan view the streamtubes produced for a given array of injection and production wells by different sets of injection and production rates.

This invention describes a procedure for determining the optimum injection and producing rates in a petroleum reservoir undergoing an injection program. The first step of the process of the invention involves the generation of a finite number of streamtubes for different sets of injection and production rates. A streamtube is the depiction, usually graphical, of the travel path of an arbitrary fluid particle through the reservoir from the time it leaves the injection well and enters the reservoir until it either enters a production well or passes out of the area of interest. Such fluid paths are normally marked to indicate the time needed for the particle to pass from point to point along the particular streamtube.

Streamtubes can be generated for a given set of injection and production rates by any one of a number of different methods. One such method is that disclosed by B. D. Lee and G. Herzog in U.S. Pat. No. 2,683,563 issued July 13, 1954. An electrical potentiometric model is proposed in this patent which can be used to model so called "flow lines" between injection and production wells in a petroleum reservoir. This technique is quite well known in the art and its implementation is relatively straight-forward to one skilled in the art.

Another method for the generation of streamtubes is by the use of a suitably programmed general purpose digital computer. One such program has been developed based on the work of R. J. Merrick in his 1969 Ph.D thesis at the University of Texas, entitled *Streamline Flow Solutions for Predicting Recoveries by Cycling Multiwell, Anisotropic, Stratified Gas Fields.* The program utilized Merrick's potential theory and particle velocity-tracking techniques to generate plots of the streamtubes. Briefly, the program computes the number of streamtubes issuing from an injection well based on a specified injection rate, originates and extends the streamtubes a small radial distance from the injection well, places an imaginary fluid particle in each streamtube, tracks the motion of each such particle in each streamtube until it reaches a production well or leaves the area of interest and then either plots the motion of the various particles or provides XY coordinate data describing such motion. The program as utilized is relatively simple and its development does not present any serious obstacles to one skilled in the art of computer programming.

Undoubtedly other methods of generating the streamtubes will be readily apparent to those skilled in the art. The two techniques mentioned above are illustrative but should not be considered as limitative.

The next step in the practice of the method of this invention involves comparing the percentage of streamtubes exhibiting breakthrough to producing wells versus time for each of the different sets injection and production rates for the area of interest. Each injection well will serve as the origin for a particular number of streamtubes, the number of which is dependent upon the injection rate for that well. When the streamtube paths are generated, all of the wells which could affect the fluid particle motion within the area of interest as well as boundary conditions such as permeability barriers and natural water drives must be incluuded in the streamtube plot generation process. Consequently, it is probable that a certain number of streamtubes will terminate outside of the area of interest and that others will be subject to very low particle velocities. The streamtube plot for the area of interest would be examined to ascertain the number of streamtubes that breakthrough to a producing well within the area of interest. This would be converted into a cumulative percentage of the total number of streamtubes originating at the injection wells and plotted as a function of time of breakthrough. This plot of cumulative percentage of streamtubes exhibiting breakthrough versus time of breakthrough is made for each set of injection and production rates.

The final step in the practice of the method of this invention comprises selecting an efficient set, preferably the most efficient set, of injection and production rates on the basis of the above cumulative percentage plots. Each set of injection and production rates will produce its own unique streamtube plot and resulting cumulative percentage plot. Selection of the set of injection and production rates is made by determining the set that provides a high overall percentage of streamtubes exhibiting breakthrough to producing wells within the area of interest within a reasonable length of time. This set represents an efficient solution in terms of the sweep coverage of an injected fluid through the reservoir's volume within a set period of time. This in turn readily leads to usage of this set of injection and production rates in enhanced oil recovery programs such as waterfloods, miscible floods using $CO_2$ and LP gas and surfactant floods which can achieve their best results only if the injection and production rates which are utilized give efficient fluid sweep coverage of the reservoir.

The following example is offered as an illustration of the use of the method of this invention as applied in the field but should not be deemed as limiting the scope of the invention thereto.

EXAMPLE 1

Figure 2:
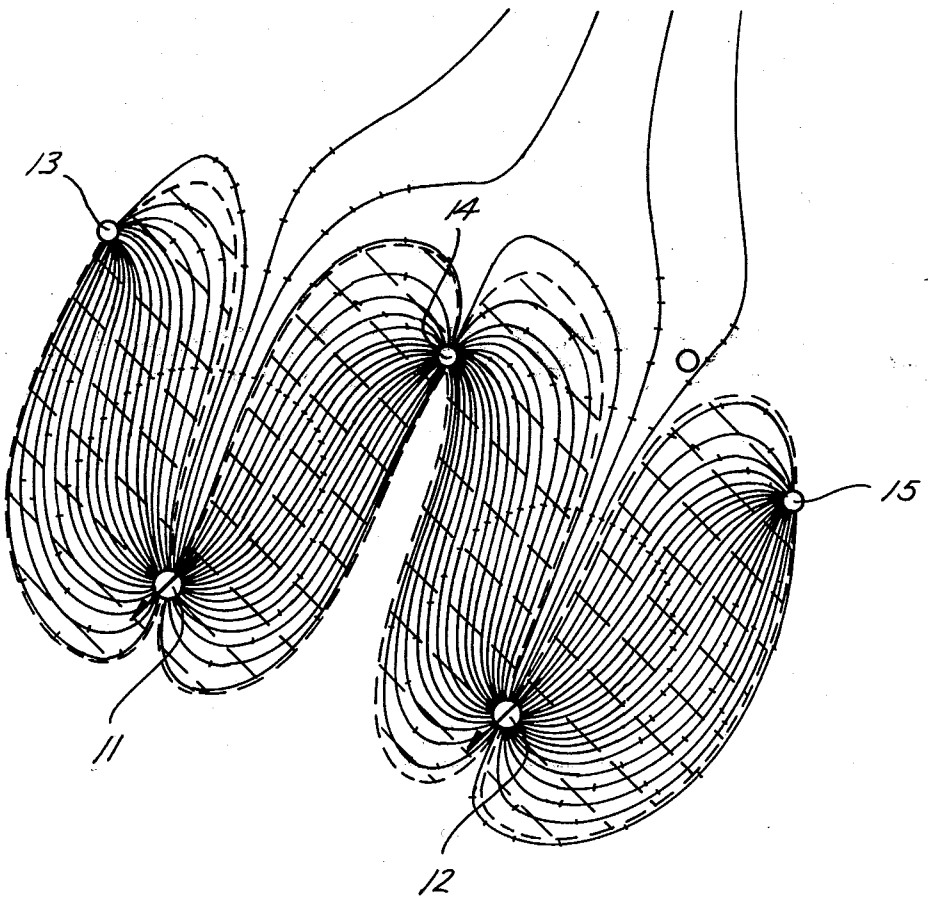
Figure 3:
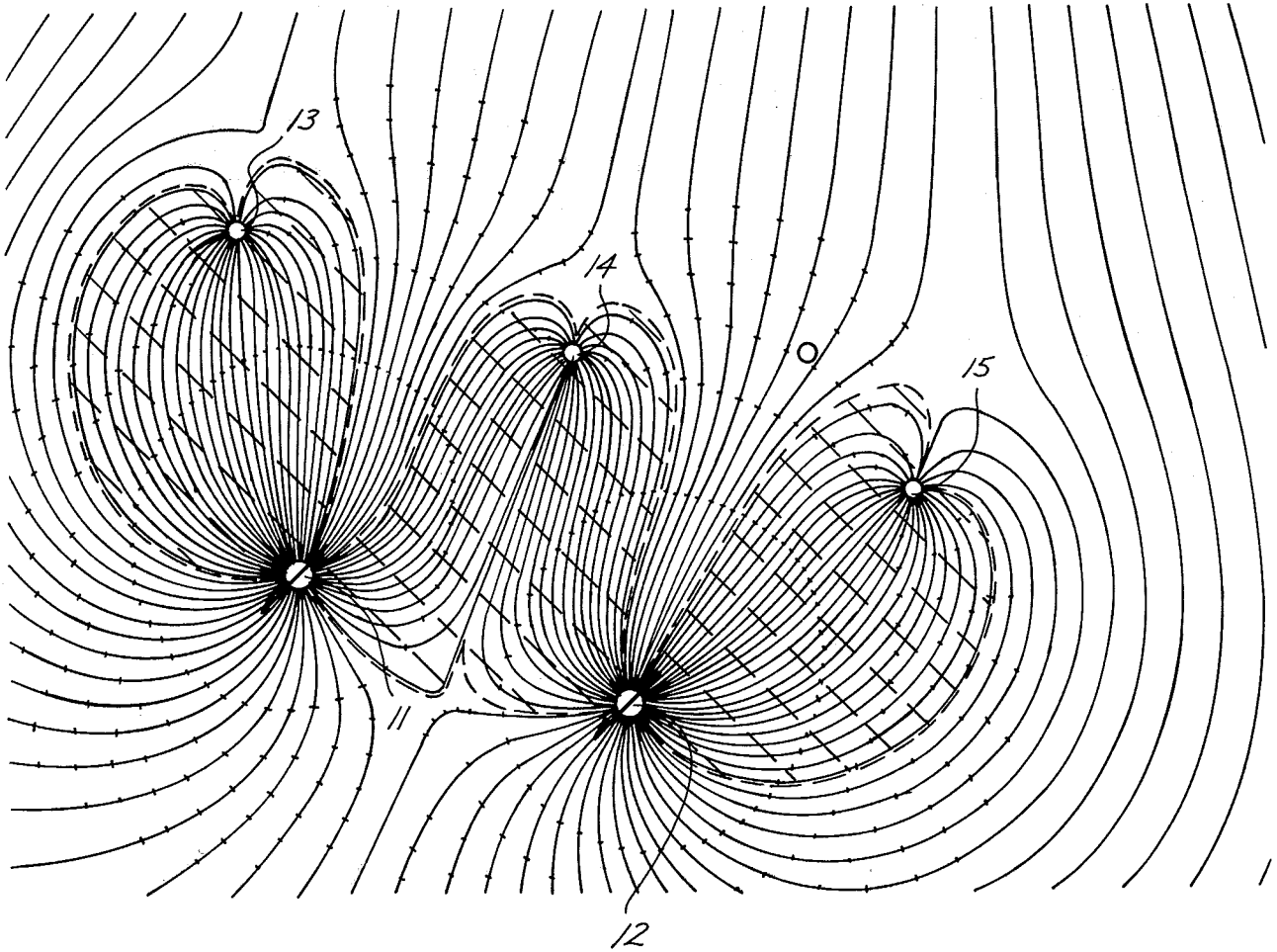
Figure 4:
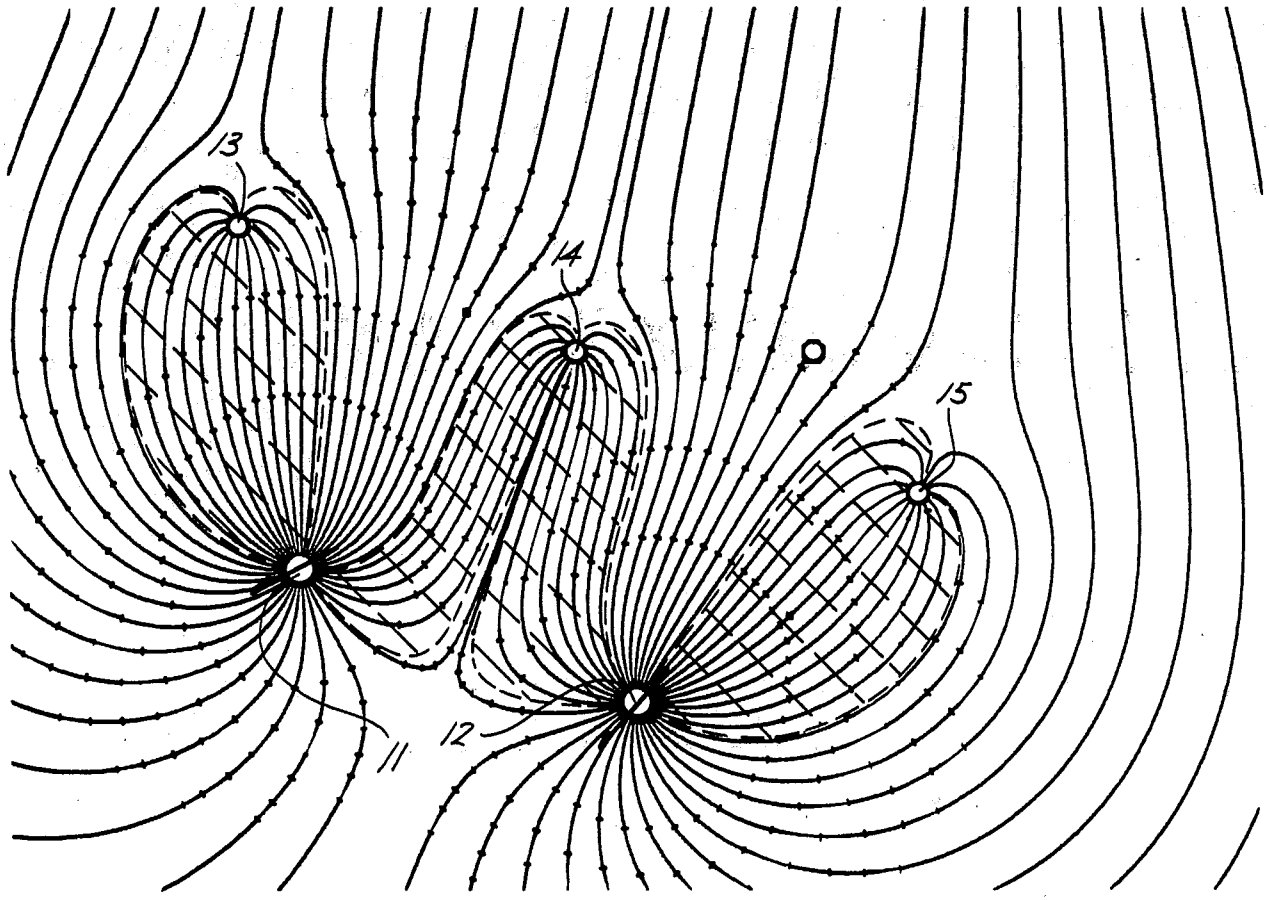

The Manvel Field of eastern Texas is a mature oilfield that has undergone enhanced oil recovery techniques for some time. A pilot program was proposed utilizing two injection wells and three production wells. The reservoir is subject to a strong natural water drive and is partially bounded by sealing faults. Other reservoir parameters such as porosity, thickness of pay zone, permeability, location of other wells, and fluid viscosities were known and entered into the computer program which then generated the streamtube plots for the different injection and production rates. These streamtube plots are shown in FIGS. 1, 2, 3, and 4. The streamtube plot in FIG. 1 was produced by an injection rate of 1,000 barrels/day in each injection well, 11 and 12, (injected total=2,000 barrels/day) and a total production rate for the three producing wells, 13, 14 and 15, of 2,000 barrels/day (667 barrels/day each). FIG. 2 corresponds to 3,000 barrels/day total injection, 2,000 barrels/day total production. FIG. 4 corresponds to 2,000 barrels/day total injection, 1,000 barrels/day total production. The crosshatched areas within the dotted lines represent those streamtubes which exhibited breakthrough in 660 days or less. Each streamtube has tick marks along its length representing 100 day time intervals.

Figure 5:
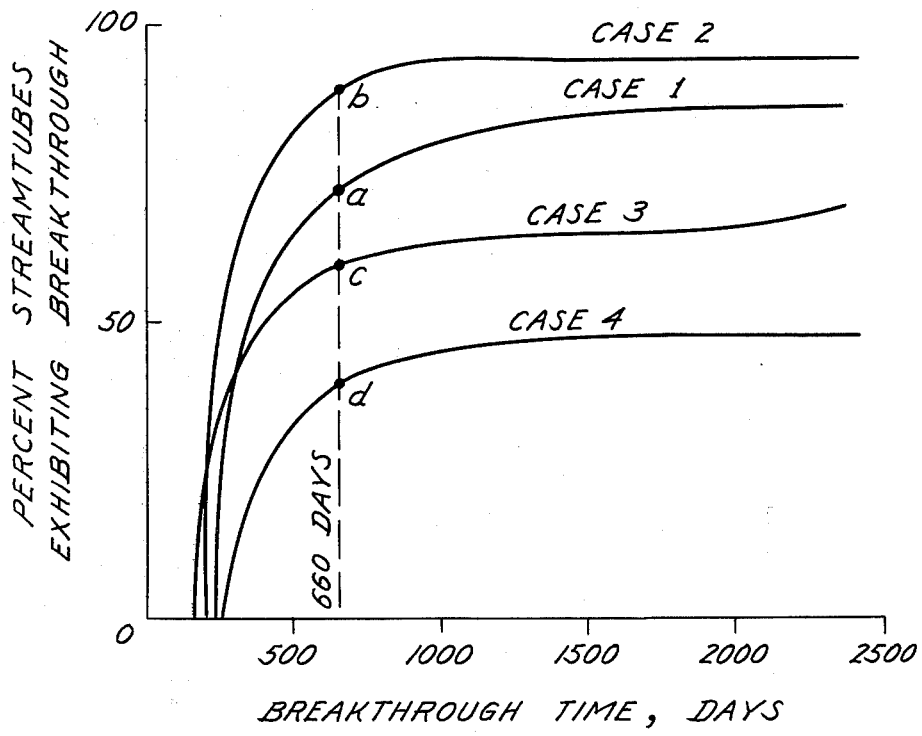
FIG. 5 represents a graph of the cumulative percentage of streamtubes that have broken through to the producing wells as a function of the time required for breakthrough.

Cumulative percentage plots were then made for each of the four different sets of injection and production rates. These plots were then combined for ease of comparison and are shown in FIG. 5 as the curves labelled case 1, 2, 3 and 4 corresponding respectively to the injection-production rates of FIGS. 1, 2, 3 and 4. A time limit of 660 days was selected as a reasonable length of time in which to expect the pilot pattern to respond. The intersections of the curves for cases 1, 2, 3 and 4 with the 660 day time line were marked as a, b, c and d for comparison. Upon inspection the injection and production rates of 2,000 and 3,000 barrels/day depicted by case 2, producing a percentage of breakthrough of 92 at point b, were selected as being the most efficient. This set of rates was subsequently implemented during the course of the pilot project.

I claim:

1. In a method for the recovery of petroleum from a subterranean reservoir penetrated by at least one injection well and at least one production well, said wells being in fluid communication with each other through the reservoir,which comprises injecting an oil displacing fluid into the reservoir via the injection well to pass through the reservoir along a plurality of streamtubes, displacing the petroleum toward the production well and recovering petroleum from the production well, a technique for increasing the recovery efficiency of the method which comprises:

a. determining the number of streamtubes which breakthrough at the production well within a preselected period of time for a plurality of fluid injection and production rates;

b. identifying the fluid injection and production rates at which the number of streamtubes intersecting the production well is at least equal to a predetermined percentage of the total number of streamtubes; and c. injecting the oil displacing fluid and extracting the produced fluids at rates about equal to the rates determined in step b.

2. The technique of claim 1 wherein the predetermined percentage is at least 60%.

3. The technique of claim 1 wherein the predetermined percentage is at least 75 percent.

4. The technique of claim 1 wherein the predetermined percentage is equal to the maximum percentage identified.

5. A method of selecting the most efficient injection and production rates for use in oil recovery processes in a petroleum reservoir wherein the reservoir is penetrated by at least one injection well and at least one production well said wells being in fluid communication with each other and wherein the reservoir characteristics of porosity, permeability, thickness, structure, amount and type of natural waterdrive and the effects of surrounding wells are determinable or known comprising:

a. generating a finite number of streamtubes for a pattern of said injection and production wells for different sets of injection and production rates, p1 b. comparing for each injection well the percentage of streamtubes exhibiting breakthrough to a producing well versus time for breakthrough for each of the different sets of injection and production rates, and c. selecting the set of injection and production rates corresponding to a percentage of streamtubes exhibiting breakthrough within a reasonable time at least equal to a predetermined percentage of the total number of streamtubes.

6. The method claim 5 wherein the predetermined percentage is at least 60 percent.

7. The method of claim 5 wherein the predetermined percentage is at least 75 percent.

8. The method of claim 5 wherein the predetermined percentage is equal to the maximum percentage of streamtubes exhibiting breakthrough that was identified.

* * * * *